US009770647B1

(12) United States Patent
Hsu

(10) Patent No.: US 9,770,647 B1
(45) Date of Patent: Sep. 26, 2017

(54) DEALING SHOE STRUCTURE

(71) Applicant: Tien-Shu Hsu, Taichung (TW)

(72) Inventor: Tien-Shu Hsu, Taichung (TW)

( * ) Notice: Subject to any disclaimer, the term of this patent is extended or adjusted under 35 U.S.C. 154(b) by 54 days.

(21) Appl. No.: 15/069,575

(22) Filed: Mar. 14, 2016

(51) Int. Cl.
*A63F 1/14* (2006.01)
*A63F 1/10* (2006.01)
*A63F 1/12* (2006.01)

(52) U.S. Cl.
CPC *A63F 1/14* (2013.01); *A63F 1/10* (2013.01); *A63F 1/12* (2013.01)

(58) Field of Classification Search
CPC ..... A63F 1/10; A63F 1/12; A63F 1/14; A63F 1/06
USPC ..... 273/149 R, 148 A, 149 P
See application file for complete search history.

(56) References Cited

U.S. PATENT DOCUMENTS

2007/0216092 A1* 9/2007 Fleckenstein ..... A63F 1/14 273/149 R
2013/0228971 A1* 9/2013 Flynn ..... A63F 1/14 273/149 R

* cited by examiner

*Primary Examiner* — Aarti B Berdichevsky
*Assistant Examiner* — Rayshun Peng
(74) *Attorney, Agent, or Firm* — Muncy, Geissler, Olds & Lowe, P.C.

(57) ABSTRACT

A dealing shoe structure comprises a card shoe, a card pusher device and a fixing lever. The card shoe includes a card-receiving space for receiving the poker cards, an installation space arranged below the card-receiving space, and a card-support inclined board separating the installation space from the card-receiving space. The card-support inclined board includes a control hole interconnecting with the installation space and the card-receiving space. The card pusher device is arranged in the card-receiving space and on the card-support inclined board. The fixing lever is arranged inside the installation space and includes a pivotal point pivotally connected with the card shoe; a protrudent pillar extending through the control hole into the card-receiving space. The protrudent pillar blocks the card pusher device to stay on the upper region of the card-receiving space to increase convenience of placing poker cards.

32 Claims, 20 Drawing Sheets

DEALING SHOE STRUCTURE

FIELD OF THE INVENTION

The present invention relates to a poker game device, particularly to a dealing shoe structure of poker games.

BACKGROUND OF THE INVENTION

Poker is a family of gambling card games suitable for various types of players. Poker has been the mainstream of the table games and very popularized in casinos. Shuffle is undertaken before a poker game to fully disperse the cards and provide unpredictable cards lest cheating occur.

The cards are dealt out to the players after shuffle. In order to increase confidence and avoid cheating, the shuffled cards are normally placed in a dealing shoe. A US patent No. 2007/0216092 A1 disclosed a "Card Shoe for Holding Playing Cards", which can receive several decks of playing cards and uses a gravity-driven card pusher device to move the cards to a card discharge hole, whereby the dealer can take cards from the card discharge hole and deal the cards to the players.

The conventional dealing shoe has a disadvantage: while placing several decks of playing cards into the dealing shoe, the dealer must use one hand to take several decks of playing cards and use the other hand to move the card pusher device to the topmost region to empty the space for the several decks of playing cards. Only skilled and experienced dealers can well execute such an operation. If the dealer should drop the playing cards imprudently, the dealer must shuffle the playing cards once again, which not only waste the time of players but also affect the confidence of the players to the card dealing and the card dealer. Therefore, the conventional technology still has room to improve.

SUMMARY OF THE INVENTION

The primary objective of the present invention is to provide a dealing shoe structure, which can hold the card pusher device.

The present invention, which is used to receive poker cards and deal out the poker cards, may be realized by various embodiments. In one embodiment, the dealing shoe structure of the present invention comprises a card shoe, a card pusher device and a fixing lever. The card shoe includes a casing, a card-receiving space arranged inside the casing for receiving the poker cards, an installation space arranged below the card-receiving space, and a card-support inclined board separating the installation space from the card-receiving space. The casing includes a side hole. The card-support inclined board includes a control hole interconnecting with the installation space and the card-receiving space. The card pusher device is arranged in the card-receiving space and on the card-support inclined board for pushing the poker cards. The fixing lever is arranged inside the installation space and includes a pivotal point pivotally connected with the card shoe; a protrudent pillar extending through the control hole into the card-receiving space to control the card pusher device; a control rod passing through the side hole and operated by the user to make the protrudent pillar sink below the card-support inclined board; and a position-restoring element keeping the protrudent pillar protruding into the card-receiving space.

In another embodiment, the dealing shoe structure of the present invention comprises a card shoe, a card pusher device, and a magnetic fixing lever. The card shoe includes a casing, a card-receiving space arranged inside the casing for receiving the poker cards, an installation space arranged below the card-receiving space, and a card-support inclined board separating the installation space from the card-receiving space. The casing includes a side hole. The card pusher device is arranged in the card-receiving space and on the card-support inclined board for pushing the poker cards. The card pusher device includes a first magnet arranged near the card-support inclined board. The magnetic fixing lever is disposed inside the installation space and includes a second magnet arranged corresponding the first magnet. The magnetic fixing lever involves a first position and a second position. At the first position, the first magnet attracts the second magnet of the magnetic fixing lever, whereby the card pusher device is fixed. At the second position, the second magnet of the magnetic fixing lever is separated from the first magnet, whereby the fixing is unlocked and the card pusher device is released. The magnetic fixing lever includes a control rod passing through the side hole and a position-restoring element. The user operates the control rod to move the magnetic fixing lever from the first position to the second position. The position-restoring element restores the magnetic fixing lever to the first position.

In yet another embodiment, the dealing shoe structure of the present invention comprises a card shoe, a card pusher device, a leading element, and a fixing lever. The card shoe includes a casing, a card-receiving space arranged inside the casing for receiving the poker cards, an installation space arranged below the card-receiving space, and a card-support inclined board separating the installation space from the card-receiving space. The casing includes a side hole. The card-support inclined board includes a control hole interconnecting with the installation space and the card-receiving space. The card pusher device is arranged in the card-receiving space and on the card-support inclined board for pushing the poker cards. The leading element is fixed to the casing and includes at least two leading slots. The fixing lever is disposed in the installation space and slidably installed in the two leading slots. The fixing lever includes a protrudent pillar extending through the control hole into the card-receiving space to control the card pusher device; a control rod passing through the side hole and operated by the user to make the protrudent pillar sink below the card-support inclined board; and a position-restoring element keeping the protrudent pillar protruding into the card-receiving space.

In a further embodiment, the dealing shoe structure of the present invention comprises a card shoe, a card pusher device and a fixing lever. The card shoe includes a casing, a card-receiving space arranged inside the casing for receiving the poker cards, and a card-support inclined board. The casing includes a side hole. The card pusher device is arranged in the card-receiving space on the card-support inclined board for pushing the poker cards. The card pusher device includes a first hook. The fixing lever is arranged inside the card-receiving space and includes a second hook able to hook the first hook, a control rod passing through the side hole and operated by the user to make the second hook separated from the first hook, and a position-restoring element restoring the second hook to the original position to hook the first hook.

The present invention is characterized in using the protrudent pillar, the second hook or the magnetic fixing lever to block, hook or attract the card pusher device to stay on the upper region of the card-receiving space. Thereby, the dealer can easily place the poker cards into the card-receiving space. After the poker cards are placed inside the card-receiving space, the dealer releases the protrudent pillar, the second hook or the magnetic fixing lever and pushes the card pusher device to deal out the poker cards. Therefore, the present invention can increase convenience and satisfy requirement in usage.

DETAILED DESCRIPTION OF THE PREFERRED EMBODIMENTS

Figure 1:
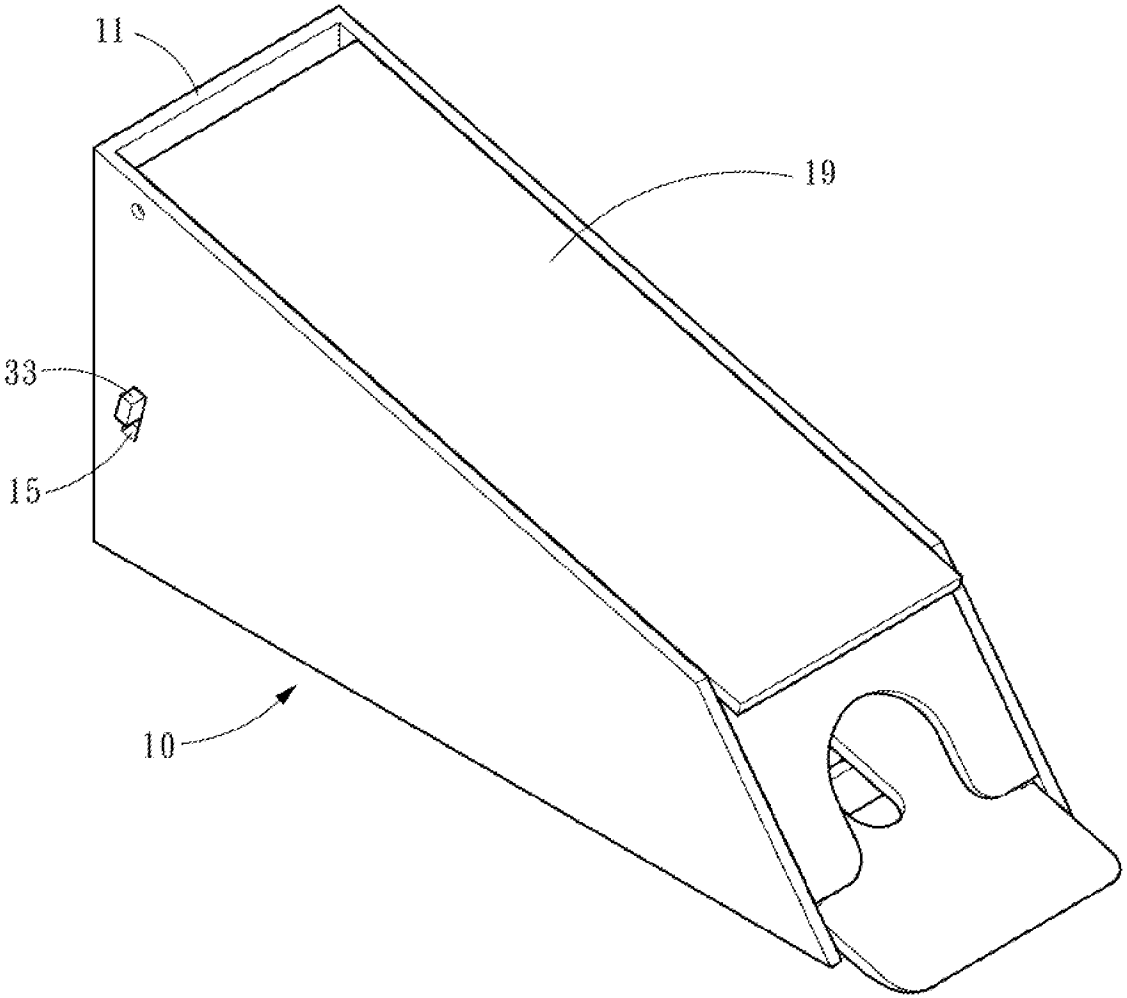
FIG. 1 is a perspective view schematically showing a dealing shoe structure according to one embodiment of the present invention.

Below, embodiments are described in detail in cooperation with the attached drawings to make easily understood the objectives, characteristics and efficacies of the present invention.

Refer to FIG. 1, FIG. 2, FIG. 3A and FIG. 3B for a first embodiment of the present invention. In the first embodiment, the dealing shoe structure of the present invention is used to receive poker cards and deal out the poker cards and comprises a card shoe 10, a card pusher device 20 and a fixing lever 30. The card shoe 10 includes a casing 11, a card-receiving space 12 arranged inside the casing 11 for receiving the poker cards, an installation space 13 arranged below the card-receiving space 12, and a card-support inclined board 14 separating the installation space 13 from the card-receiving space 12. The casing 11 includes a side hole 15. The card-support inclined board 14 includes a control hole 16 interconnecting with the installation space 13 and the card-receiving space 12. The card pusher device 20 is arranged in the card-receiving space 12 and on the card-support inclined board 14 for pushing the poker cards.

The fixing lever 30 is arranged inside the installation space 13 and includes a pivotal point 31 pivotally connected with the card shoe 10; a protrudent pillar 32 extending through the control hole 16 into the card-receiving space 12 to control the card pusher device 20; a control rod 33 passing through the side hole 15 and operated by the user to make the protrudent pillar 32 sink below the card-support inclined board 14; and a position-restoring element 34 keeping the protrudent pillar 32 protruding into the card-receiving space 12.

In one embodiment, the position-restoring element 34 is arranged in one side of the pivotal point 31, and the protrudent pillar 32 and the control rod 33 are arranged in the other side of the pivotal point 31. In one embodiment, the position-restoring element 34 is an elastic element 341, and the elastic element 341 presses against the card-support inclined board 14. The fixing lever 30 includes a recess 342 for receiving the elastic element 341. In one embodiment, the card-support inclined board 14 hangs a vertical plate 141, and the pivotal point 31 is pivotally connected with the vertical plate 141.

In one embodiment, the dealing shoe structure of the present invention further comprises a guiding element 17 arranged inside the card-receiving space 12. The guiding element 17 includes two guiding strips 171 respectively arranged on the left side and the right side of the card-receiving space 12 to form a gradually-shrinking opening 18 for guiding the poker cards into the card-receiving space 12. In one embodiment, the dealing shoe structure of the present invention further comprises a top cover 19 pivotally connected with the casing 11 for covering the card-receiving space 12 and sheltering the poker cards inside the card-receiving space 12.

Figure 4:
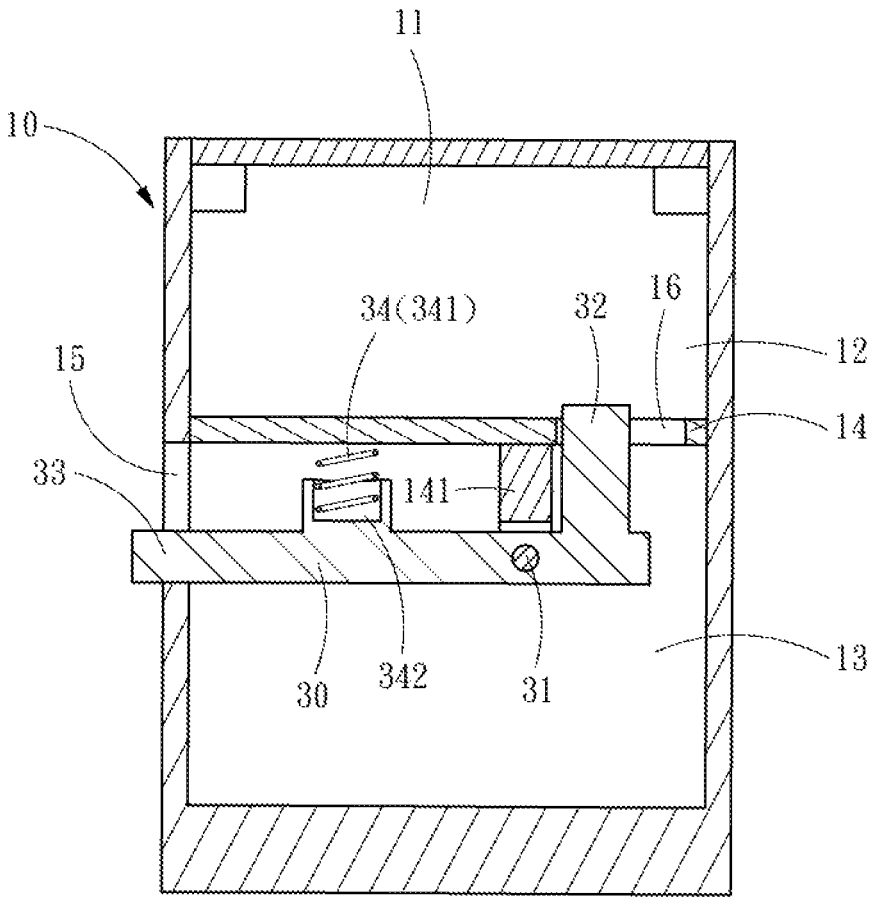
FIGS. 4-15 are sectional views respectively schematically showing the dealing shoe structures according to Embodiments 2-13 of the present invention.

Refer to FIG. 4 for a second embodiment of the present invention. In the second embodiment, the position-restoring element 34 and the control rod 33 are arranged in one side of the pivotal point 31, and the protrudent pillar 32 is arranged in the other side of the pivotal point 31; the position-restoring element 34 is an elastic element 341, and the elastic element 341 presses against the card-support inclined board 14; the fixing lever 30 includes a recess 342 for receiving the elastic element 341; the card-support inclined board 14 hangs a vertical plate 141, and the pivotal point 31 is pivotally connected with the vertical plate 141.

Figure 5:
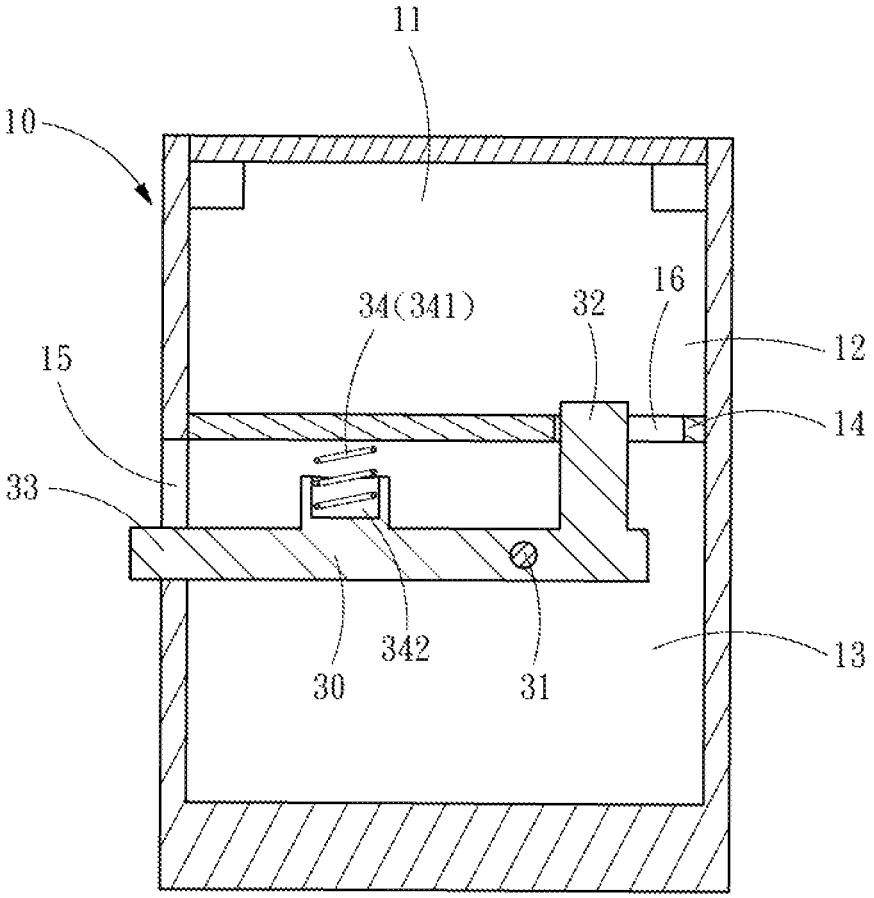

Refer to FIG. 5 for a third embodiment of the present invention. In the third embodiment, the position-restoring element 34 and the control rod 33 are arranged in one side of the pivotal point 31, and the protrudent pillar 32 is arranged in the other side of the pivotal point 31; the position-restoring element 34 is an elastic element 341, and the elastic element 341 presses against the card-support inclined board 14; the fixing lever 30 includes a recess 342 for receiving the elastic element 341; the pivotal point 31 is directly pivotally connected with the casing 11.

Figure 6:
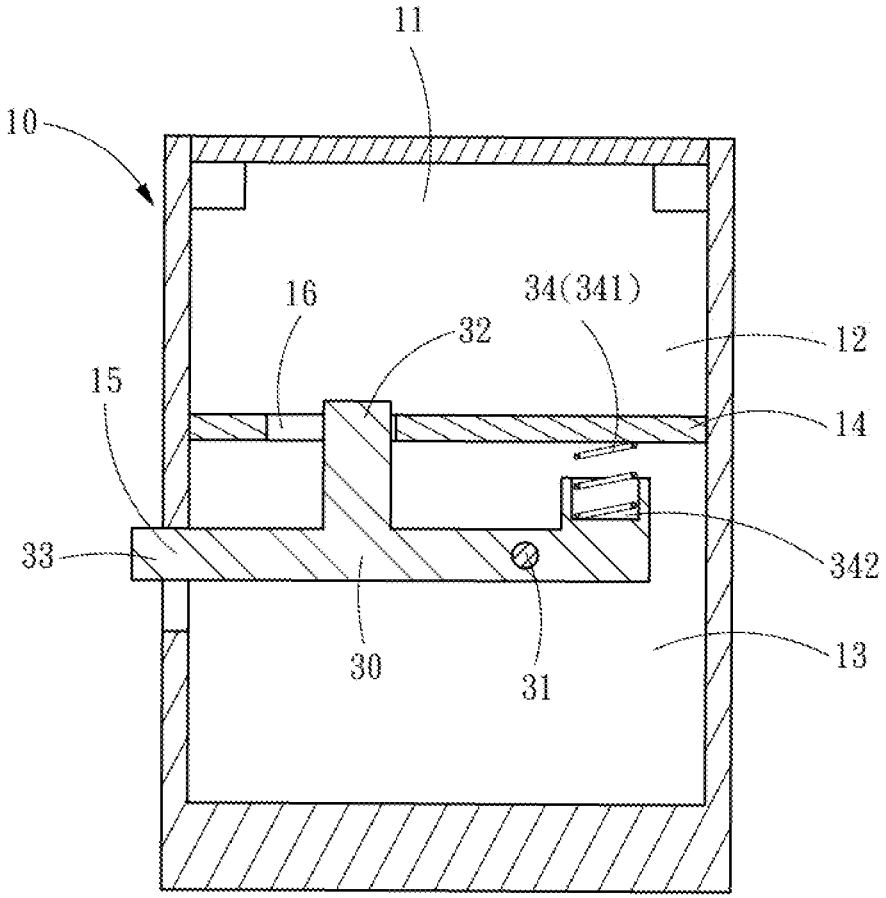

Refer to FIG. 6 for a fourth embodiment of the present invention. In the fourth embodiment, the position-restoring element 34 is arranged in one side of the pivotal point 31, and the protrudent pillar 32 and the control rod 33 are arranged in the other side of the pivotal point 31; the position-restoring element 34 is an elastic element 341, and the elastic element 341 presses against the card-support inclined board 14; the fixing lever 30 includes a recess 342 for receiving the elastic element 341; the pivotal point 31 is directly pivotally connected with the casing 11.

Figure 7:
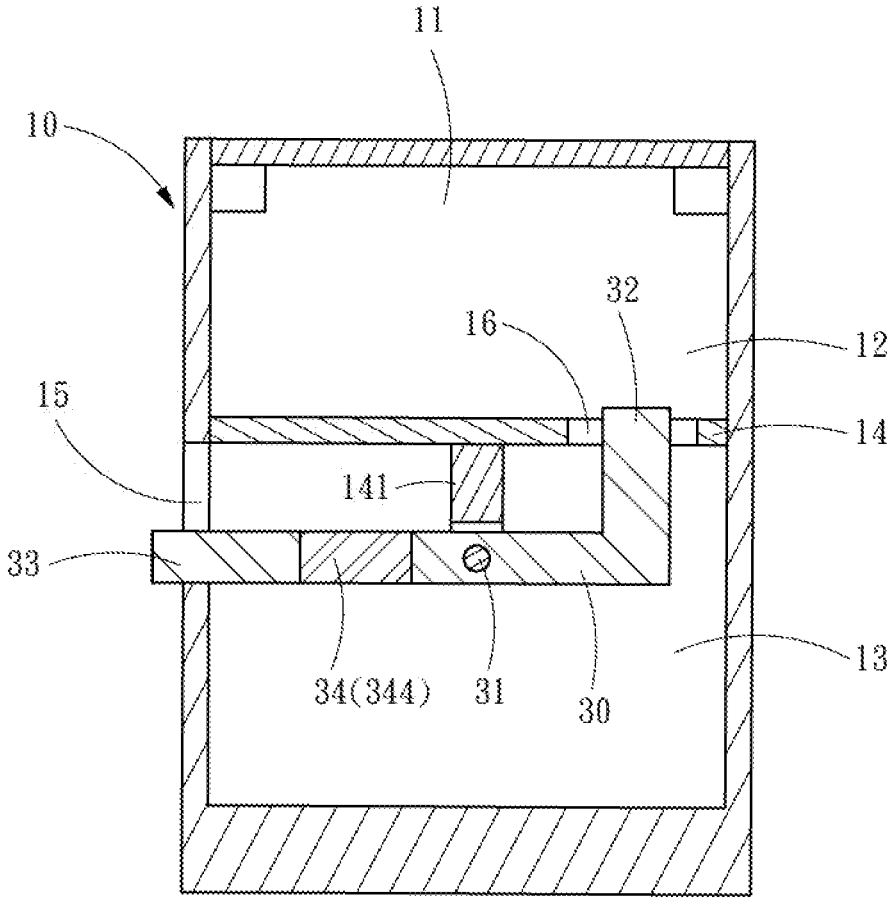

Refer to FIG. 7 for a fifth embodiment of the present invention. In the fifth embodiment, the position-restoring element 34 and the control rod 33 are arranged in one side of the pivotal point 31, and the protrudent pillar 32 is arranged in the other side of the pivotal point 31; the position-restoring element 34 is a counterweight 344; the card-support inclined board 14 hangs a vertical plate 141, and the pivotal point 31 is pivotally connected with the vertical plate 141.

Figure 8:
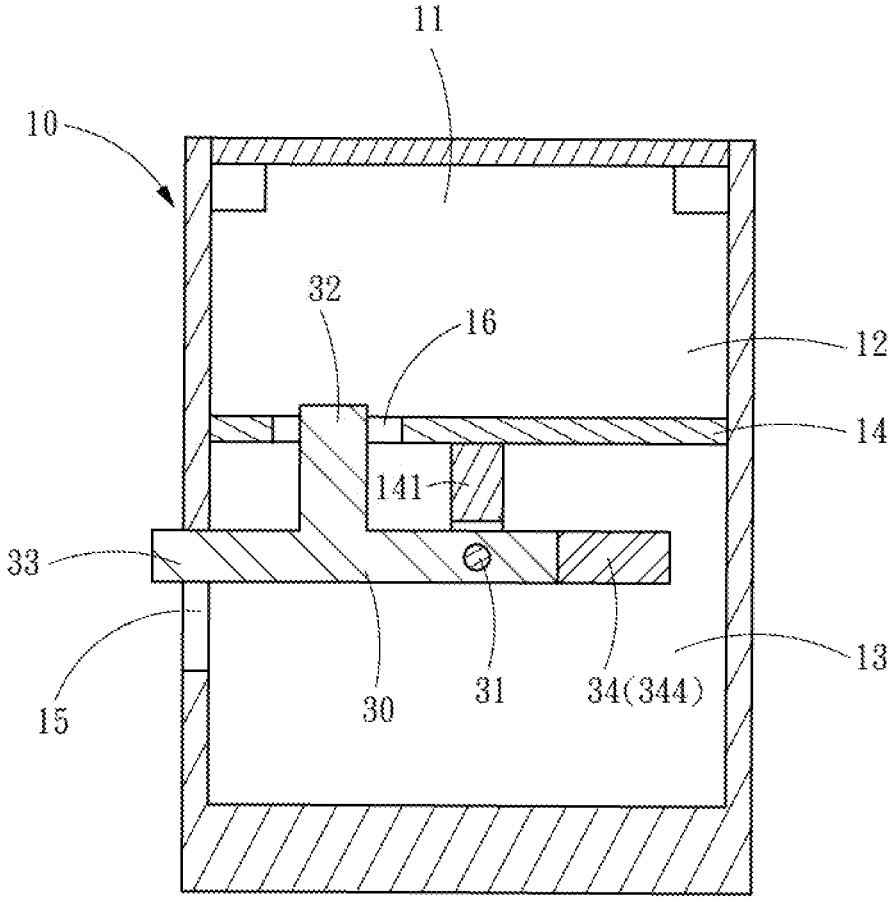

Refer to FIG. 8 for a sixth embodiment of the present invention. In the sixth embodiment, the position-restoring element 34 is arranged in one side of the pivotal point 31, and the protrudent pillar 32 and the control rod 33 are arranged in the other side of the pivotal point 31; the position-restoring element 34 is a counterweight 344; the card-support inclined board 14 hangs a vertical plate 141, and the pivotal point 31 is pivotally connected with the vertical plate 141.

Figure 9:
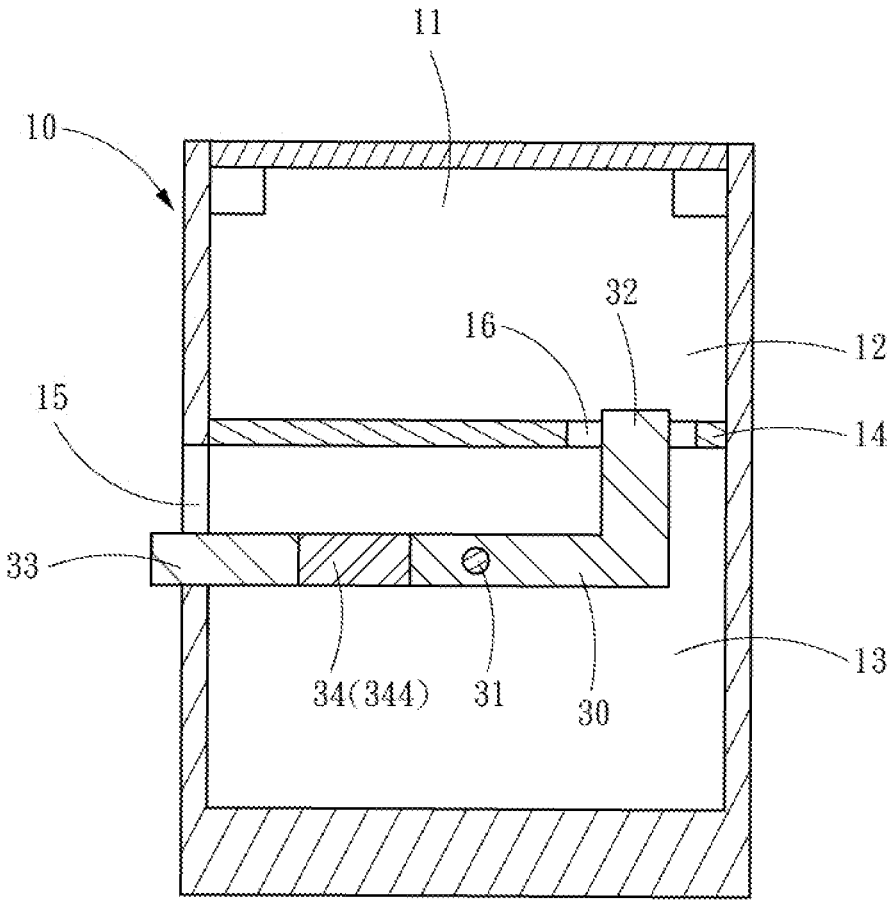

Refer to FIG. 9 for a seventh embodiment of the present invention. In the seventh embodiment, the position-restoring element 34 and the control rod 33 are arranged in one side of the pivotal point 31, and the protrudent pillar 32 is arranged in the other side of the pivotal point 31; the position-restoring element 34 is a counterweight 344; the pivotal point 31 is directly pivotally connected with the casing 11.

Figure 10:
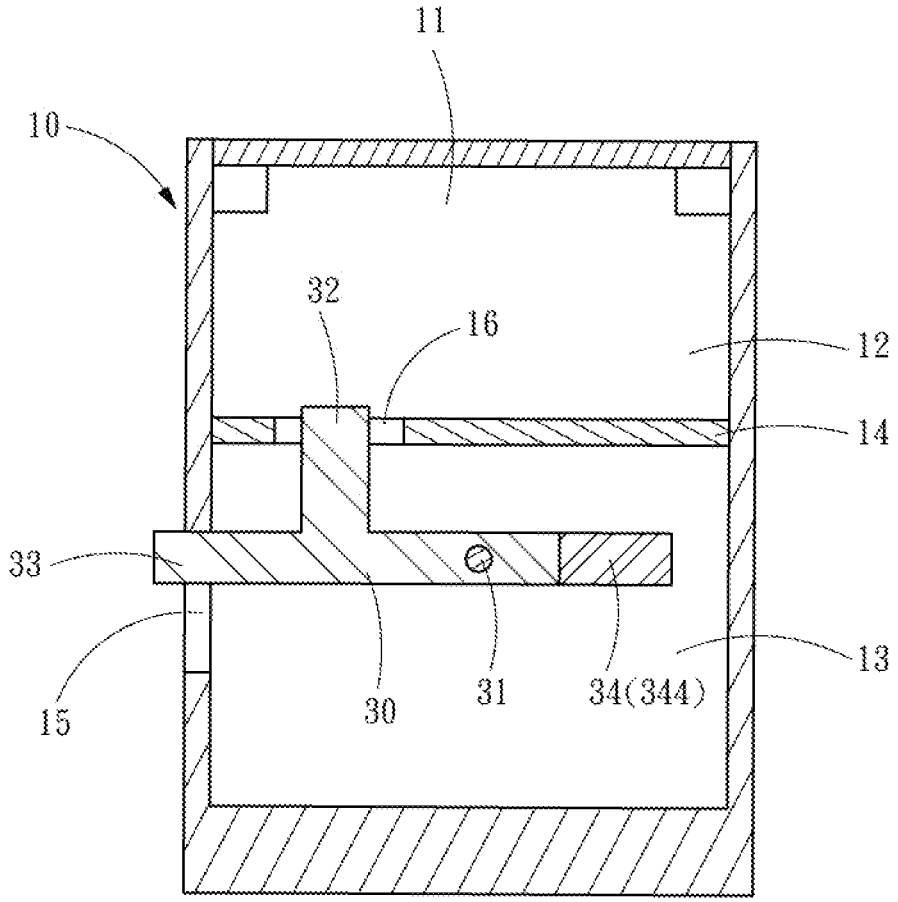

Refer to FIG. 10 for an eighth embodiment of the present invention. In the eighth embodiment, the position-restoring element 34 is arranged in one side of the pivotal point 31, and the protrudent pillar 32 and the control rod 33 are arranged in the other side of the pivotal point 31; the position-restoring element 34 is a counterweight 344; the pivotal point 31 is directly pivotally connected with the casing 11.

Figure 11:
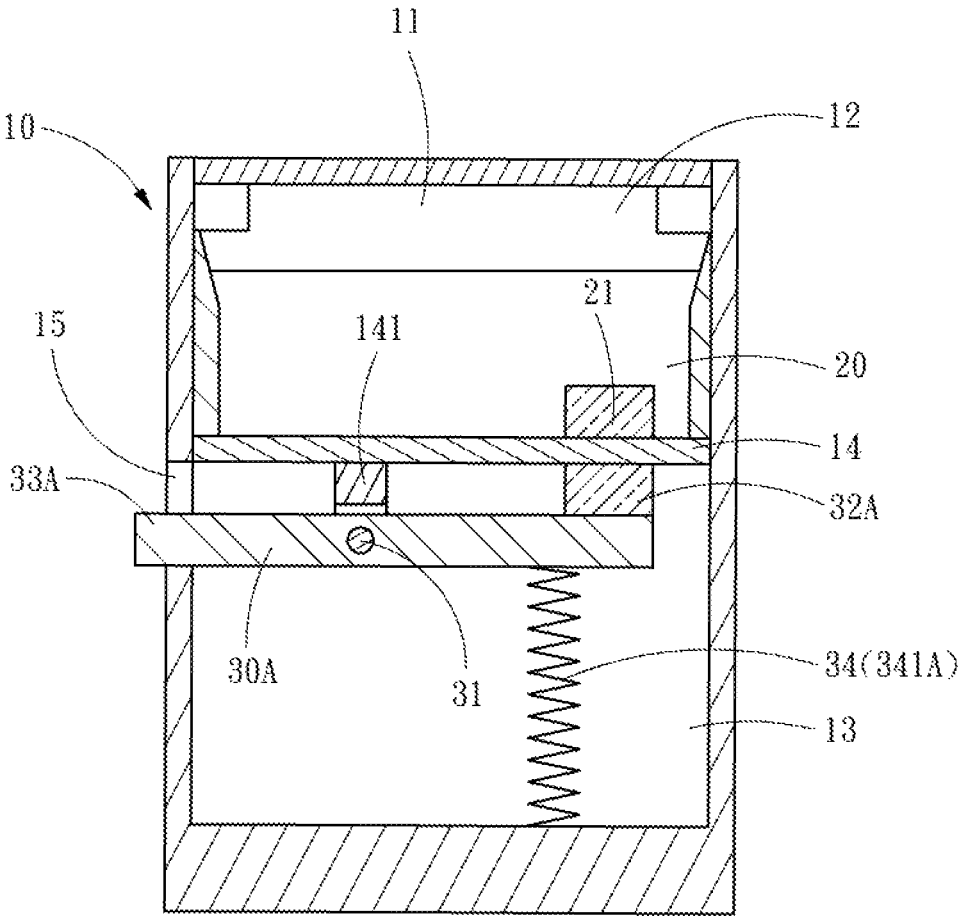

Refer to FIG. 11 for a ninth embodiment of the present invention. In the ninth embodiment, the dealing shoe structure of the present invention comprises a card shoe 10, a card pusher device 20, and a magnetic fixing lever 30A. The card shoe 10 includes a casing 11, a card-receiving space 12 arranged inside the casing 11 for receiving the poker cards, an installation space 13 arranged below the card-receiving space 12, and a card-support inclined board 14 separating the installation space 13 from the card-receiving space 12. The casing 11 includes a side hole 15. The card pusher device 20 is arranged in the card-receiving space 12 and on the card-support inclined board 14 for pushing the poker cards. The card pusher device 20 includes a first magnet 21 arranged near the card-support inclined board 14. The magnetic fixing lever 30A is disposed inside the installation space 13 and includes a second magnet 32A arranged corresponding the first magnet 21. The magnetic fixing lever 30A involves a first position and a second position. At the first position, the first magnet 21 attracts the second magnet 32A of the magnetic fixing lever 30A, whereby the card pusher device 20 is fixed. At the second position, the second magnet 32A of the magnetic fixing lever 30A is separated from the first magnet 21, whereby the fixing is unlocked and the card pusher device 20 is released. The magnetic fixing lever 30A includes a control rod 33A passing through the side hole 15 and a position-restoring element 34. The user operates the control rod 33A to move the magnetic fixing lever 30A from the first position to the second position. The position-restoring element 34 restores the magnetic fixing lever 30A to the first position.

The magnetic fixing lever 30A includes a pivotal point 31 pivotally connected with the card shoe 10. The position-restoring element 34 and the second magnet 32A are arranged in one side of the pivotal point 31. The control rod 33A is arranged in the other side of the pivotal point 31 and operated by the user to separate the second magnet 32A from the card-support inclined board 14. The position-restoring element 34 is an elastic element 341A, and the elastic element 341A pushes the second magnet 32A to approach the card-support inclined board 14. The card-support inclined board 14 hangs a vertical plate 141, and the pivotal point 31 is pivotally connected with the vertical plate 141.

Figure 12:
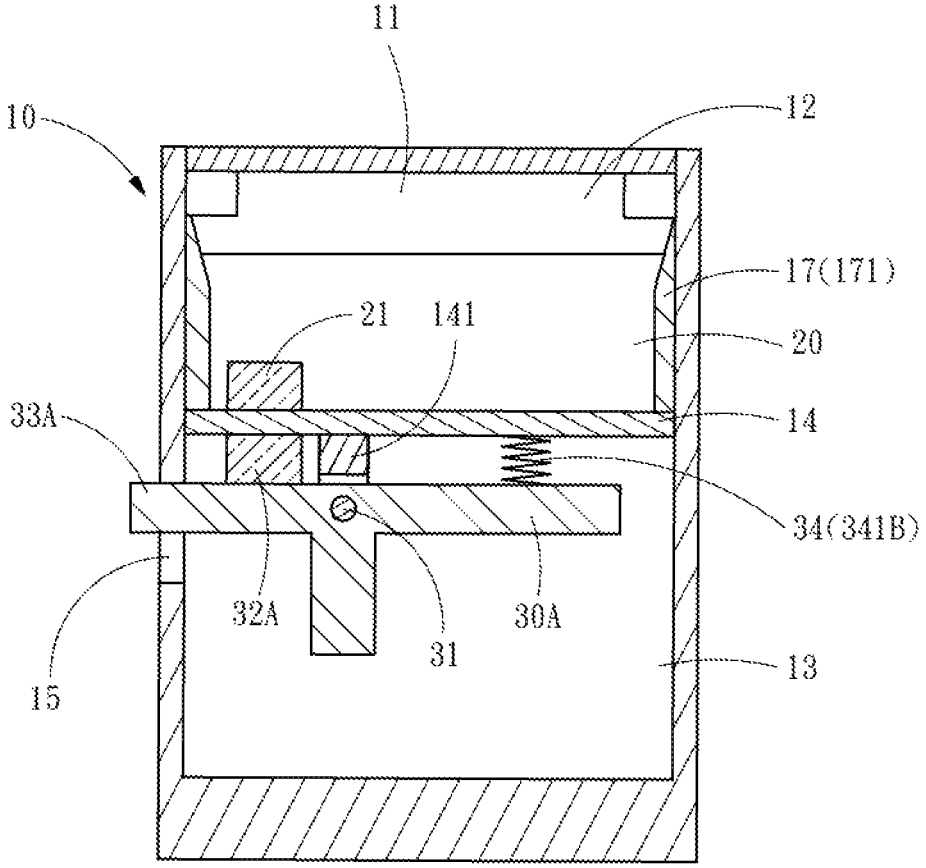

Refer to FIG. 12 for a tenth embodiment of the present invention. In the tenth embodiment, the magnetic fixing lever 30A includes a pivotal point 31 pivotally connected with the card shoe 10; the position-restoring element 34 is arranged in one side of the pivotal point 31; the control rod 33A, together with the second magnet 32A, is arranged in the other side of the pivotal point 31 and operated by the user to separate the second magnet 32A from the card-support inclined board 14; the position-restoring element 34 is an elastic element 341B, and the two ends of the elastic element 341B are respectively connected with the card-support inclined board 14 and the magnetic fixing lever 30A; the card-support inclined board 14 hangs a vertical plate 141, and the pivotal point 31 is pivotally connected with the vertical plate 141.

Figure 13:
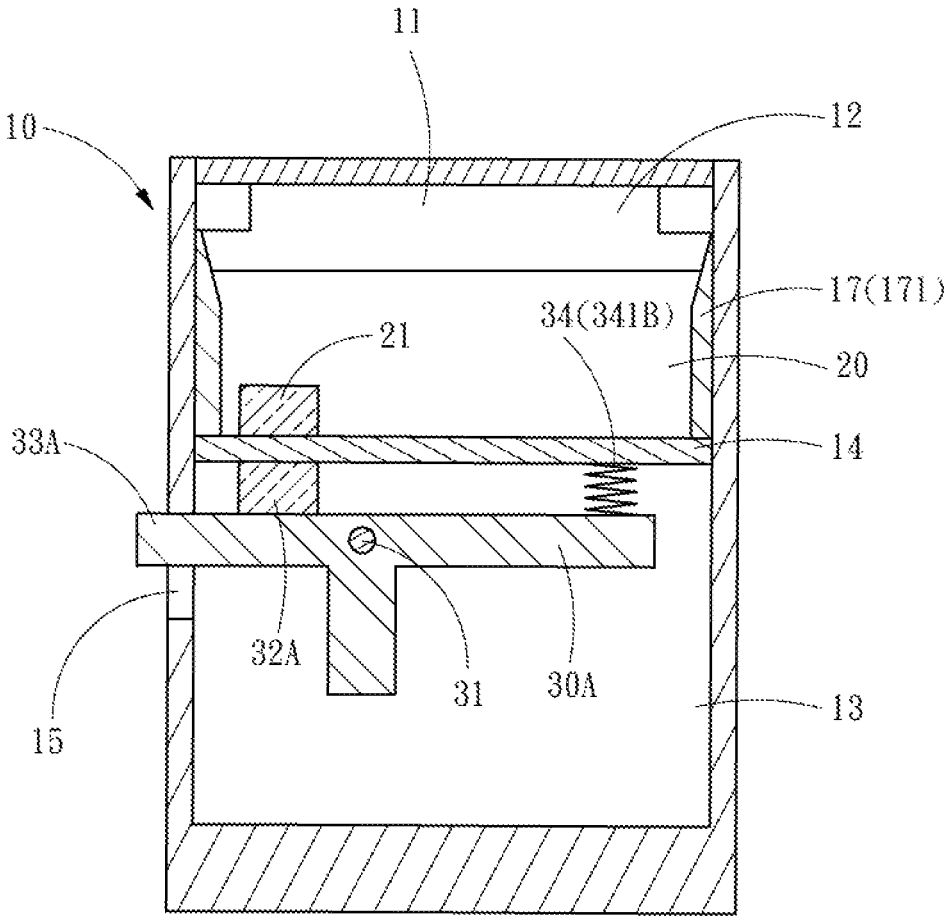

Refer to FIG. 13 for an eleventh embodiment of the present invention. In the eleventh embodiment, the magnetic fixing lever 30A includes a pivotal point 31 pivotally connected with the card shoe 10; the position-restoring element 34 is arranged in one side of the pivotal point 31; the control rod 33A, together with the second magnet 32A, is arranged in the other side of the pivotal point 31 and operated by the user to separate the second magnet 32A from the card-support inclined board 14; the position-restoring element 34 is an elastic element 341B, and the two ends of the elastic element 341B are respectively connected with the card-support inclined board 14 and the magnetic fixing lever 30A; the pivotal point 31 is directly pivotally connected with the casing 11.

Figure 14:
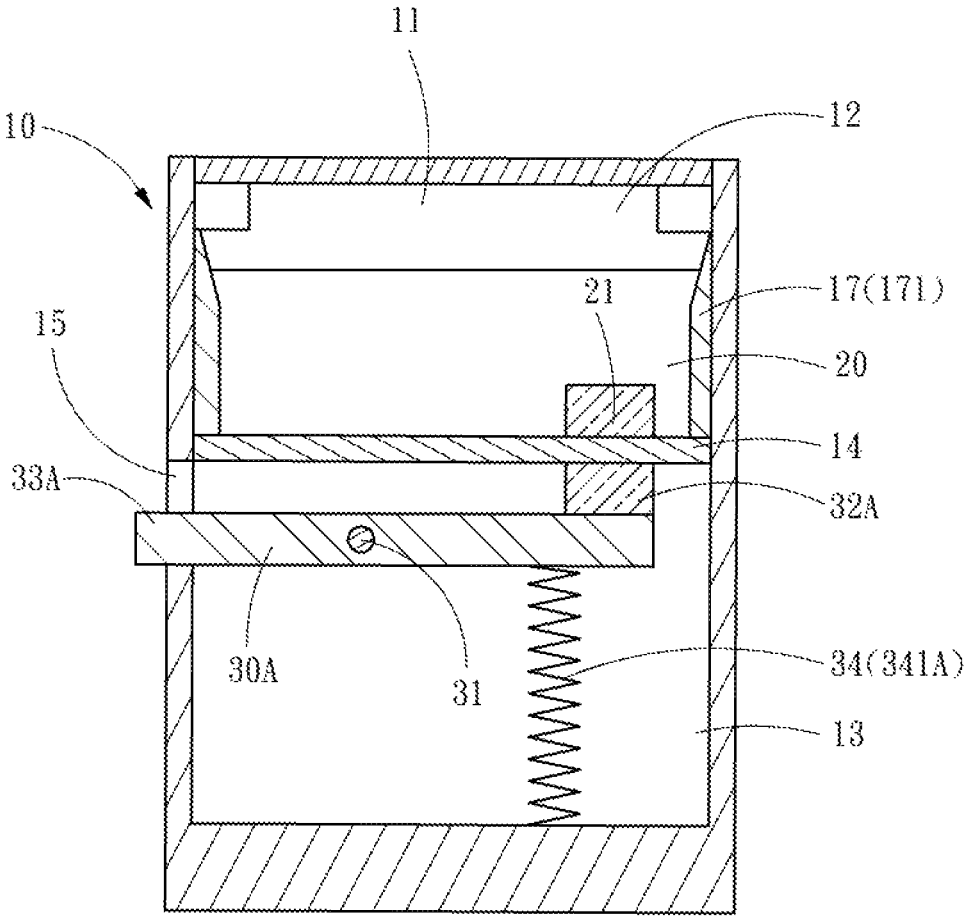

Refer to FIG. 14 for a twelfth embodiment of the present invention. In the twelfth embodiment, the magnetic fixing lever 30A includes a pivotal point 31 pivotally connected with the card shoe 10; the position-restoring element 34 and the second magnet 32A are arranged in one side of the pivotal point 31; the control rod 33A is arranged in the other side of the pivotal point 31 and operated by the user to separate the second magnet 32A from the card-support inclined board 14; the position-restoring element 34 is an elastic element 341A, and the two ends of the elastic element 341A are respectively connected with the card-support inclined board 14 and the magnetic fixing lever 30A; the pivotal point 31 is directly pivotally connected with the casing 11.

Figure 15:
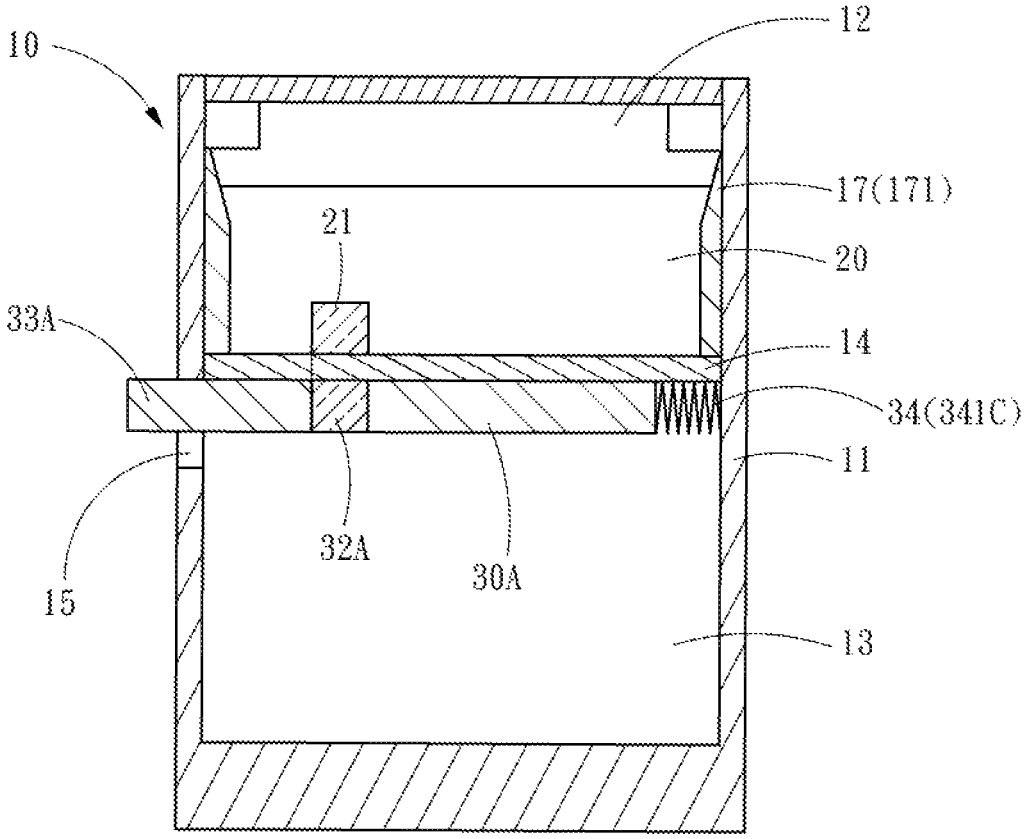

Refer to FIG. 15 for a thirteenth embodiment of the present invention. In the thirteenth embodiment, the magnetic fixing lever 30A is slidably installed in the casing 11; the position-restoring element 34 is an elastic element 341C, and the two ends of the elastic element 341C are respectively connected with the casing 11 and the magnetic fixing lever 30A.

In some embodiment, the dealing shoe structure of the present invention further comprises a guiding element 17 arranged inside the card-receiving space 12. The guiding element 17 includes two guiding strips 171 respectively arranged on the left side and the right side of the card-receiving space 12 to form a gradually-shrinking opening 18 for guiding the poker cards into the card-receiving space 12. In some embodiments, the dealing shoe structure of the present invention further comprises a top cover 19 pivotally connected with the casing 11 for covering the card-receiving space 12 and sheltering the poker cards inside the card-receiving space 12.

Figure 2:
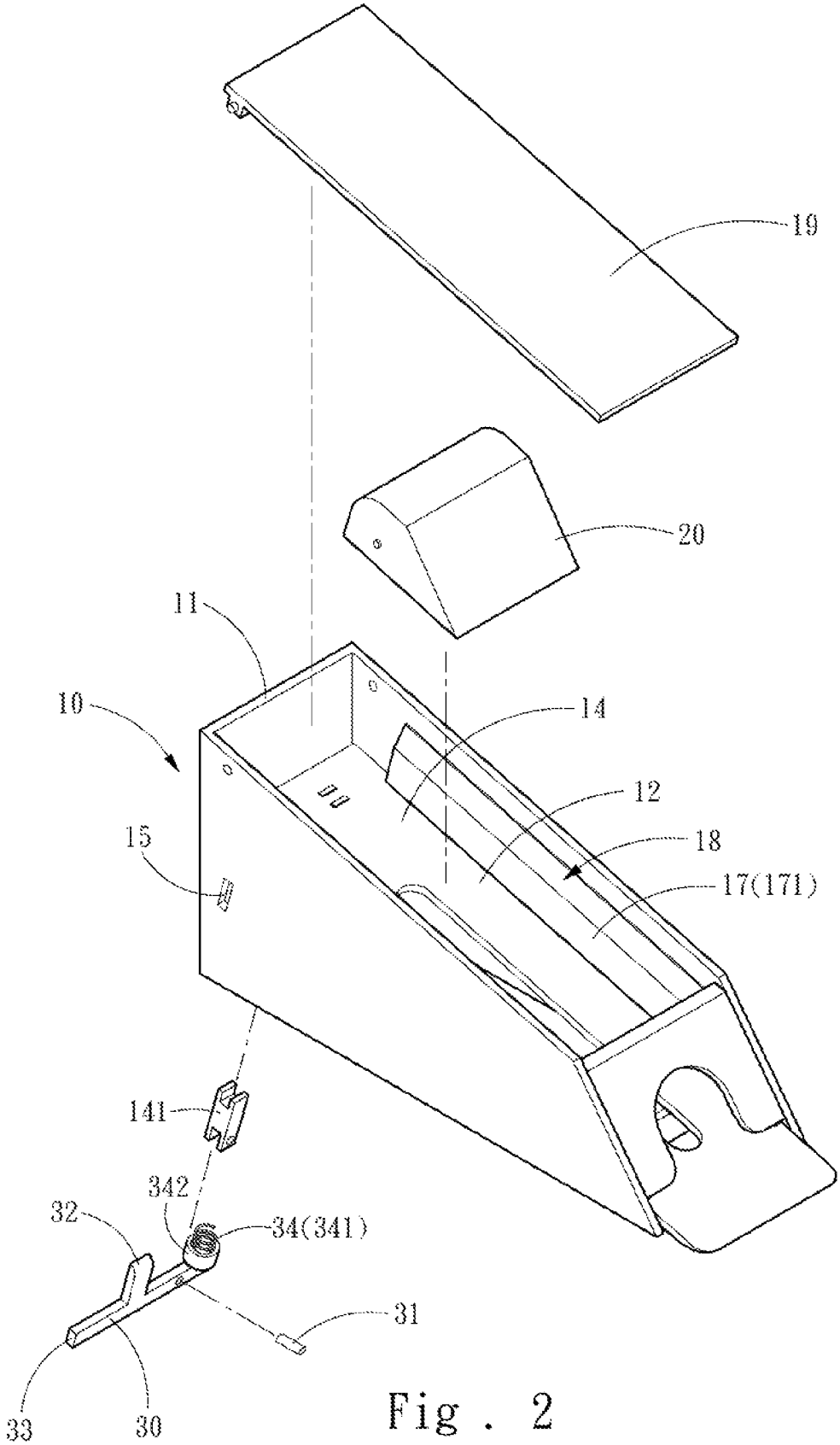
FIG. 2 is a perspective exploded view schematically showing a dealing shoe structure according to one embodiment of the present invention.
Figure 3A:
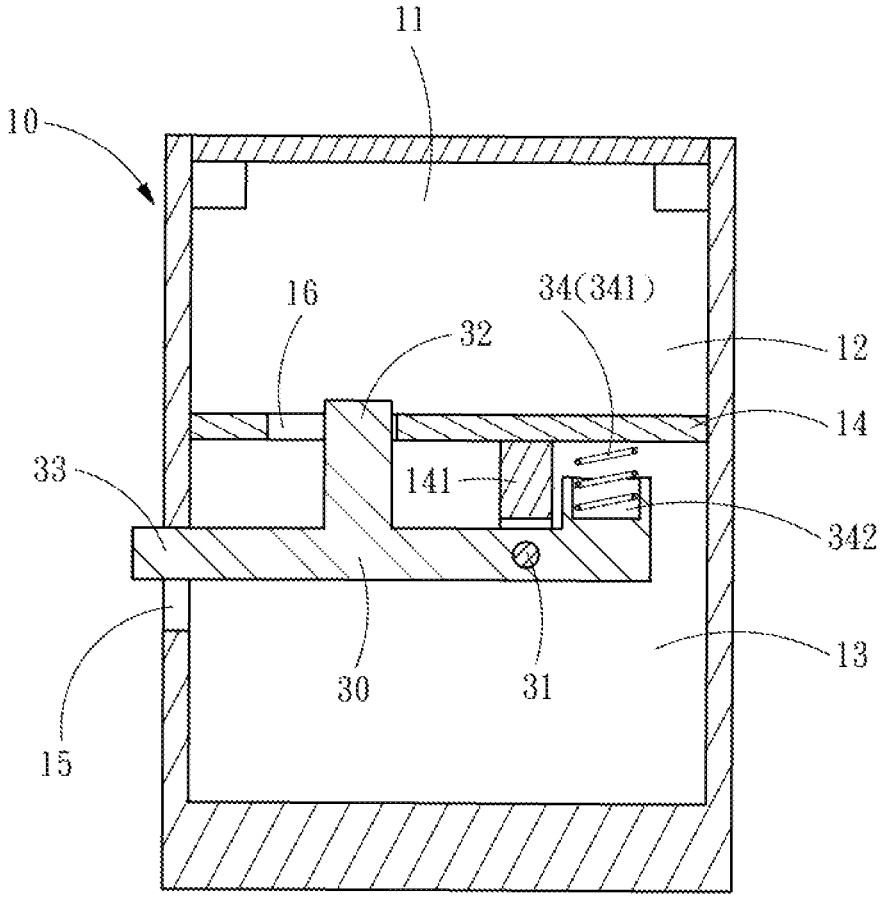
FIG. 3A is a sectional view schematically showing that the card pusher device is blocked a according to one embodiment of the present invention.
Figure 3B:
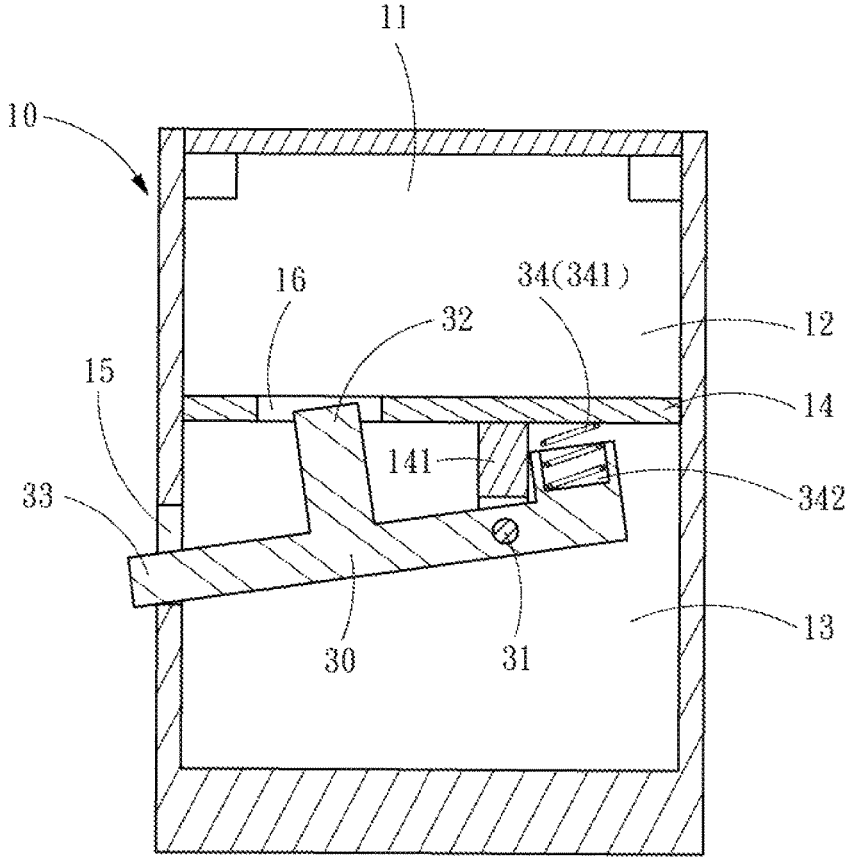
FIG. 3B is a sectional view schematically showing that the card pusher device is released according to one embodiment of the present invention.
Figure 16A:
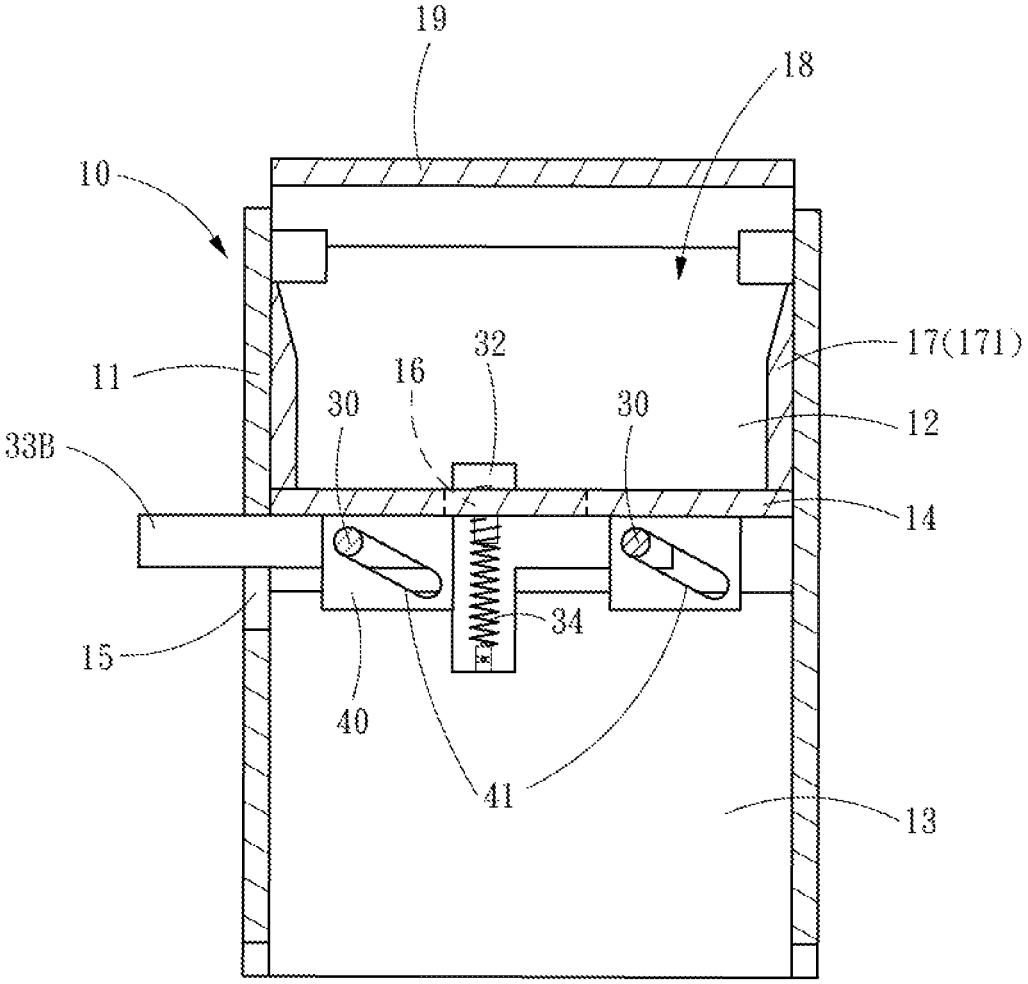
FIG. 16A and FIG. 16B are sectional views schematically showing a dealing shoe structure according to Embodiment 14 of the present invention.
Figure 16B:
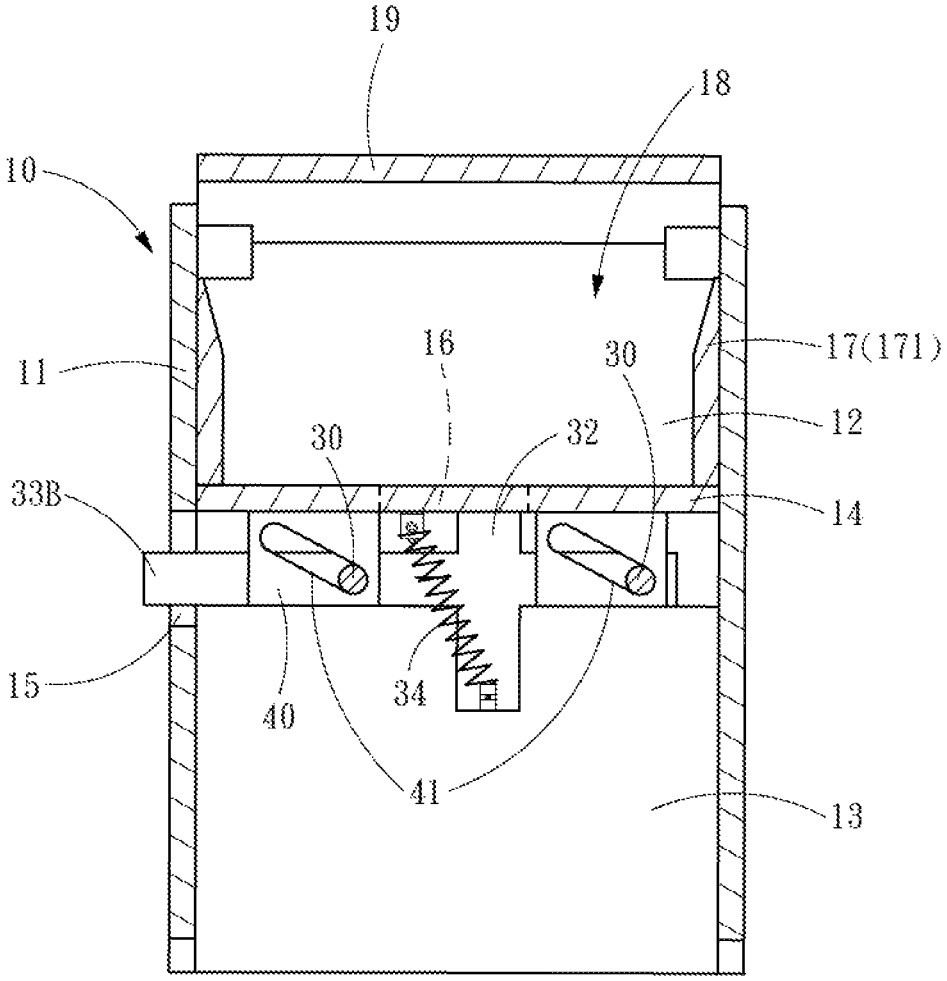

Refer to FIG. 16A and FIG. 16B for a fourteenth embodiment of the present invention. In the fourteenth embodiment, the dealing shoe structure of the present invention comprises a card shoe 10, a card pusher device 20 (as shown in FIG. 2), a fixing lever 30, and a leading element 40. The card shoe 10 includes a casing 11, a card-receiving space 12 arranged inside the casing 11 for receiving the poker cards, an installation space 13 arranged below the card-receiving space 12, and a card-support inclined board 14 separating the installation space 13 from the card-receiving space 12. The casing 11 includes a side hole 15. The card-support inclined board 14 includes a control hole 16 interconnecting with the installation space 13 and the card-receiving space 12. The card pusher device 20 is arranged in the card-receiving space 12 and on the card-support inclined board 14 for pushing the poker cards. The leading element 40 is fixed to the casing 11 and includes at least two leading slots 41. The fixing lever 30 is disposed in the installation space 13 and slidably installed in the two leading slots 41. The fixing lever 30 includes a protrudent pillar 32 extending through the control hole 16 into the card-receiving space 12 to control the card pusher device 20; a control rod 33B passing through the side hole 15 and operated by the user to make the protrudent pillar 32 sink below the card-support inclined board 14; and a position-restoring element 34 keeping the protrudent pillar 32 protruding into the card-receiving space 12.

One end of the position-restoring element 34 is secured to the casing 11, and the other end of the position-restoring element 34 is secured to the fixing lever 30. In the fourteenth embodiment, the dealing shoe structure of the present invention further comprises a guiding element 17 arranged inside the card-receiving space 12. The guiding element 17 includes two guiding strips 171 respectively arranged on the left side and the right side of the card-receiving space 12 to form a gradually-shrinking opening 18 for guiding the poker cards into the card-receiving space 12. In the fourteenth embodiment, the dealing shoe structure of the present invention further comprises a top cover 19 pivotally connected with the casing 11 for covering the card-receiving space 12 and sheltering the poker cards inside the card-receiving space 12.

Figure 17A:
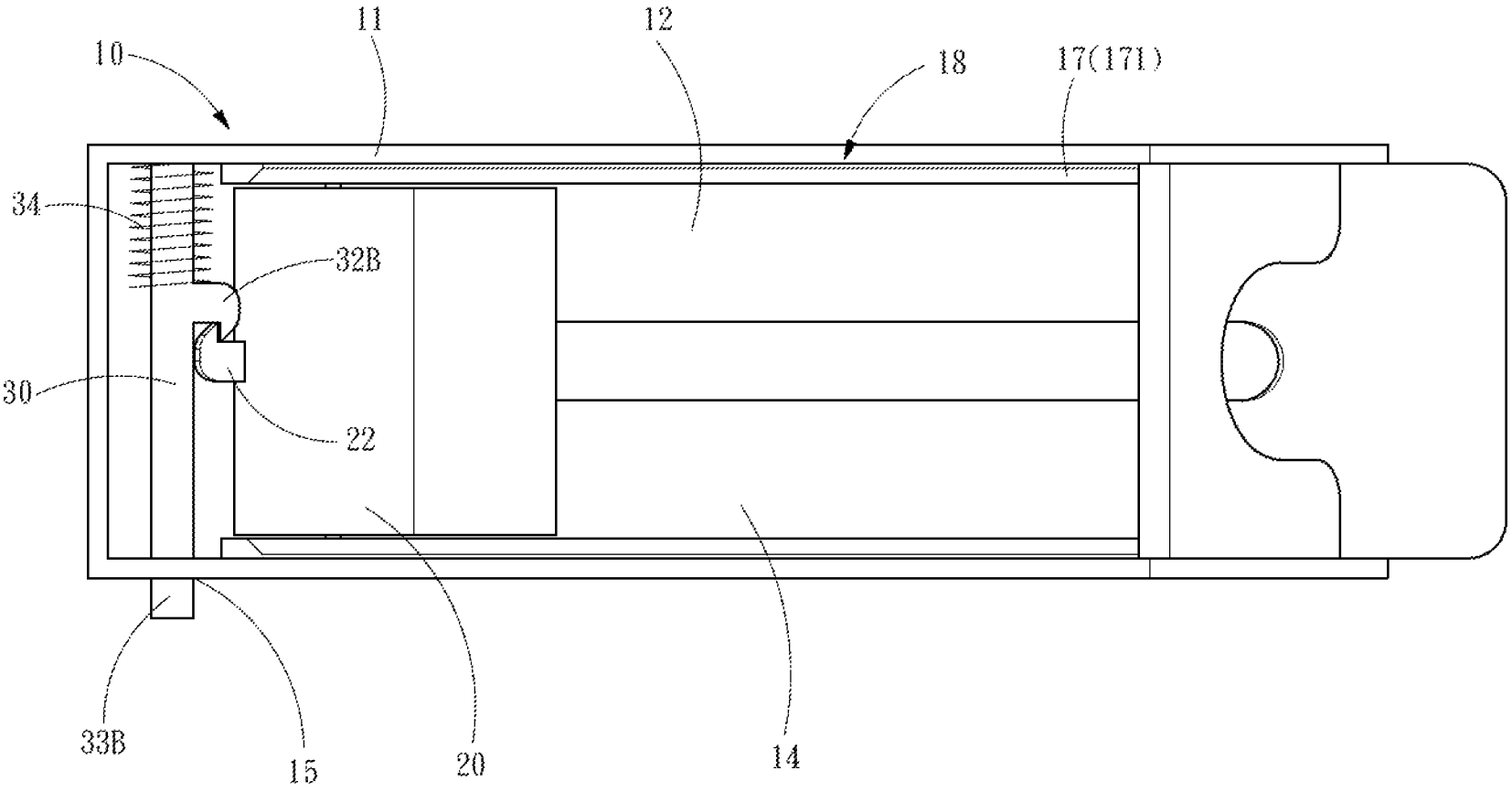
FIG. 17A and FIG. 17B are sectional views schematically showing a dealing shoe structure according to Embodiment 15 of the present invention.
Figure 17B:
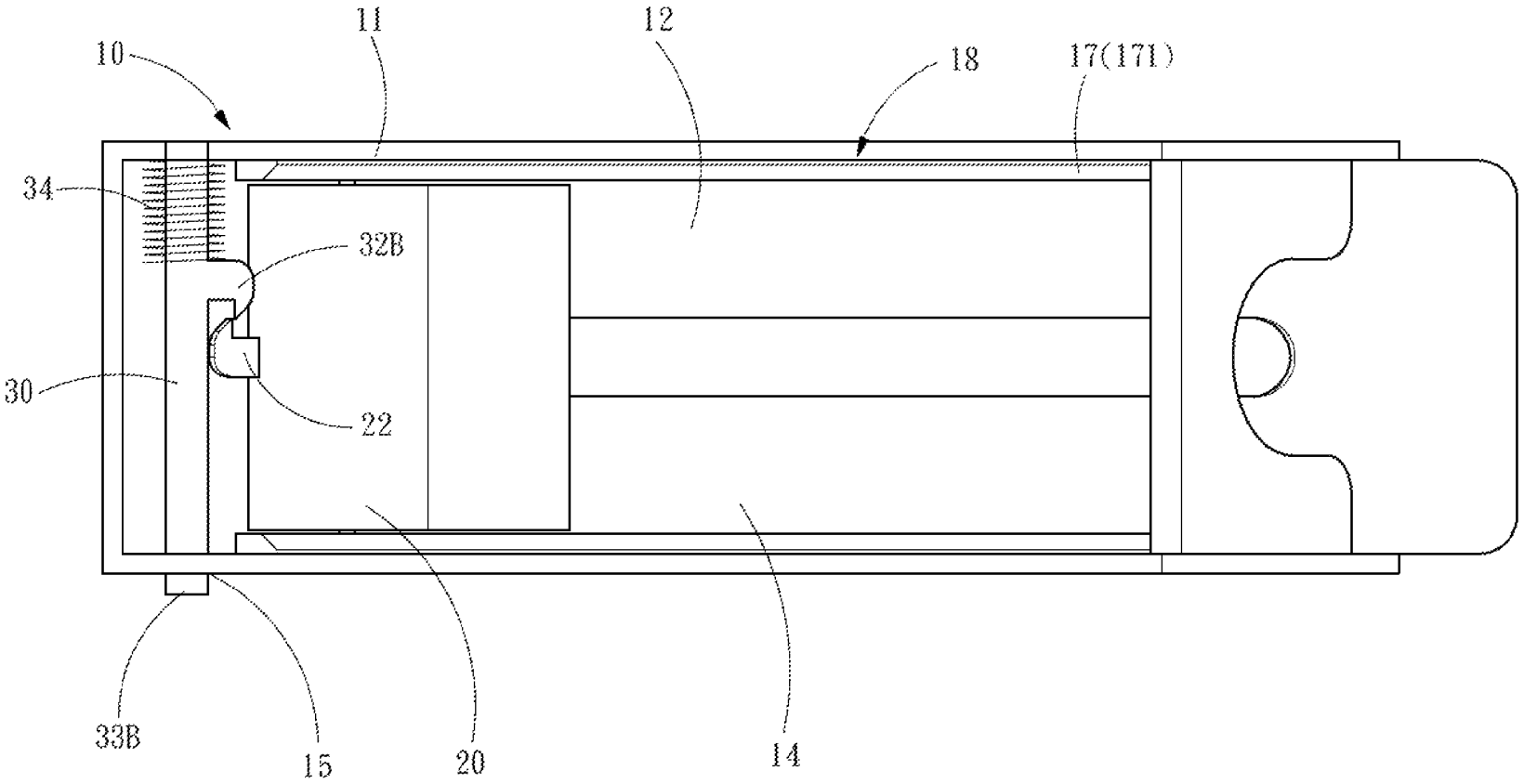

Refer to FIG. 17A and FIG. 17B for a fifteenth embodiment of the present invention. In the fifteenth embodiment, the dealing shoe structure of the present invention comprises a card shoe 10, a card pusher device 20, and a fixing lever 30. The card shoe 10 includes a casing 11, a card-receiving space 12 arranged inside the casing 11 for receiving the poker cards, and a card-support inclined board 14. The casing 11 includes a side hole 15. The card pusher device 20 is arranged in the card-receiving space 12 and on the card-support inclined board 14 for pushing the poker cards. The card pusher device 20 includes a first hook 22. The fixing lever 30 is arranged inside the card-receiving space 12 and includes a second hook 32B able to hook the first hook 22, a control rod 33B passing through the side hole 15 and operated by the user to make the second hook 32B separated from the first hook 22, and a position-restoring element 34 restoring the second hook 32B to the original position to hook the first hook 22.

One end of the position-restoring element 34 presses again the casing 11, and the other end of the position-restoring element 34 presses against the second hook 32B. In the fifteenth embodiment, the dealing shoe structure of the present invention further comprises a guiding element 17 arranged inside the card-receiving space 12. The guiding element 17 includes two guiding strips 171 respectively arranged on the left side and the right side of the card-receiving space 12 to form a gradually-shrinking opening 18 for guiding the poker cards into the card-receiving space 12. In the fifteenth embodiment, the dealing shoe structure of the present invention further comprises a top cover 19 pivotally connected with the casing 11 for covering the card-receiving space 12 and sheltering the poker cards inside the card-receiving space 12.

In summary, the present invention is characterized in using the protrudent pillar, the second hook or the magnetic fixing lever to block, hook or attract the card pusher device to stay on the upper region of the card-receiving space. Thereby, the dealer can easily place the poker cards into the card-receiving space. After the poker cards are placed inside the card-receiving space, the dealer releases the protrudent pillar, the second hook or the magnetic fixing lever and pushes the card pusher device to deal out the poker cards. Therefore, the present invention can increase convenience and satisfy requirement in usage.

The present invention has been demonstrated in detail with the embodiments. However, these embodiments are only to exemplify the present invention but not to limit the scope of the present invention. Any equivalent modification or variation according to the spirit of the present invention is to be also included within the scope of the present invention.

What is claimed is:

1. A dealing shoe structure, which is used to receive poker cards and deal out the poker cards, comprising a card shoe, including a casing, a card-receiving space arranged inside the casing for receiving the poker cards, an installation space arranged below the card-receiving space, and a card-support inclined board separating the installation space from the card-receiving space, wherein the casing includes a side hole, and wherein the card-support inclined board includes a control hole interconnecting with the installation space and the card-receiving space;

a card pusher device, arranged in the card-receiving space and on the card-support inclined board for pushing the poker cards; and a fixing lever, arranged inside the installation space and includes a pivotal point pivotally connected with the card shoe; a protrudent pillar extending through the control hole into the card-receiving space to control the card pusher device; a control rod passing through the side hole and operated to make the protrudent pillar sink below the card-support inclined board; and a position-restoring element keeping the protrudent pillar protruding into the card-receiving space.

2. The dealing shoe structure according to claim 1, wherein the position-restoring element is disposed in one side of the pivotal point, and the protrudent pillar and the control rod are disposed in another side of the pivotal point.

3. The dealing shoe structure according to claim 1, wherein the position-restoring element and the control rod are disposed in one side of the pivotal point, and the protrudent pillar is disposed in another side of the pivotal point.

4. The dealing shoe structure according to claim 2, wherein the position-restoring element is an elastic element pressing against the card-support inclined board.

5. The dealing shoe structure according to claim 4, wherein the fixing lever includes a recess for receiving the elastic element.

6. The dealing shoe structure according to claim 2, wherein the card-support inclined board hangs a vertical plate, and the pivotal point is pivotally connected with the vertical plate.

7. The dealing shoe structure according to claim 6, wherein the position-restoring element is an elastic element pressing against the card-support inclined board.

8. The dealing shoe structure according to claim 7, wherein the fixing lever includes a recess for receiving the elastic element.

9. The dealing shoe structure according to claim 6, wherein the position-restoring element is a counterweight.

10. The dealing shoe structure according to claim 2, wherein the pivotal point is pivotally connected with the casing.

11. The dealing shoe structure according to claim 10, wherein the position-restoring element is an elastic element pressing against the card-support inclined board.

12. The dealing shoe structure according to claim 11, wherein the fixing lever includes a recess for receiving the elastic element.

13. The dealing shoe structure according to claim 10, wherein the position-restoring element is a counterweight.

14. The dealing shoe structure according to claim 2, wherein the position-restoring element is a counterweight.

15. The dealing shoe structure according to claim 1 further comprising a guiding element arranged inside the card-receiving space and including two guiding strips respectively arranged on a left side and a right side of the card-receiving space to form a gradually-shrinking opening for guiding the poker cards into the card-receiving space.

16. The dealing shoe structure according to claim 1 further comprising a top cover pivotally connected with the casing and covering the card-receiving space.

17. A dealing shoe structure, which is used to receive poker cards and deal out the poker cards, comprising a card shoe, including a casing, a card-receiving space arranged inside the casing for receiving the poker cards, an installation space arranged below the card-receiving space, and a card-support inclined board separating the installation space from the card-receiving space, wherein the casing includes a side hole;

a card pusher device, arranged in the card-receiving space and on the card-support inclined board for pushing the poker cards and including a first magnet arranged near the card-support inclined board; and a magnetic fixing lever, disposed inside the installation space and including a second magnet arranged corresponding the first magnet, wherein the magnetic fixing lever involves a first position and a second position, wherein at the first position, the magnetic fixing lever uses the second magnet to attract the first magnet and fix the card pusher device, and wherein at the second position, the second magnet of the magnetic fixing lever is separated from the first magnet, and the card pusher device is released, and wherein the magnetic fixing lever includes a control rod passing through the side hole and a position-restoring element, and wherein the control rod is operated to move the magnetic fixing lever from the first position to the second position, and wherein the position-restoring element restores the magnetic fixing lever to the first position.

18. The dealing shoe structure according to claim 17, wherein the magnetic fixing lever includes a pivotal point pivotally connected with the card shoe, and wherein the position-restoring element and the second magnet are arranged in one side of the pivotal point, and the control rod is arranged in another side of the pivotal point and operated to separate the second magnet from the card-support inclined board, and wherein the position-restoring element is an elastic element, and the elastic element pushes the second magnet to approach the card-support inclined board.

19. The dealing shoe structure according to claim 17, wherein the magnetic fixing lever includes a pivotal point pivotally connected with the card shoe, and wherein the position-restoring element is arranged in one side of the pivotal point, and the control rod, together with the second magnet, is arranged in another side of the pivotal point and operated to separate the second magnet from the card-support inclined board, and wherein the position-restoring element is an elastic element, and the two ends of the elastic element respectively contact the card-support inclined board and the magnetic fixing lever.

20. The dealing shoe structure according to claim 18, wherein the card-support inclined board hangs a vertical plate, and the pivotal point is pivotally connected with the vertical plate.

21. The dealing shoe structure according to claim 18, wherein the pivotal point is pivotally connected with the casing.

22. The dealing shoe structure according to claim 17, wherein the magnetic fixing lever is slidably installed in the casing, and wherein the position-restoring element is an elastic element, and the two ends of the elastic element are respectively connected with the casing and the magnetic fixing lever.

23. The dealing shoe structure according to claim 17 further comprising a guiding element arranged inside the card-receiving space, wherein the guiding element includes two guiding strips respectively arranged on a left side and a right side of the card-receiving space to form a gradually-shrinking opening.

24. The dealing shoe structure according to claim 17 further comprising a top cover pivotally connected with the casing for covering the card-receiving space.

25. A dealing shoe structure, which is used to receive poker cards and deal out the poker cards, comprising a card shoe, including a casing, a card-receiving space arranged inside the casing for receiving the poker cards, an installation space arranged below the card-receiving space, and a card-support inclined board separating the installation space from the card-receiving space, wherein the casing includes a side hole, and wherein the card-support inclined board includes a control hole interconnecting with the installation space and the card-receiving space;

a card pusher device, arranged in the card-receiving space and on the card-support inclined board for pushing the poker cards;

a leading element, fixed to the casing and including at least two leading slots; and a fixing lever, disposed in the installation space, slidably installed in the two leading slots, and including a protrudent pillar extending through the control hole into the card-receiving space to control the card pusher device; a control rod passing through the side hole and operated to make the protrudent pillar sink below the card-support inclined board; and a position-restoring element keeping the protrudent pillar protruding into the card-receiving space.

26. The dealing shoe structure according to claim 25, wherein one end of the position-restoring element is secured to the casing, and another end of the position-restoring element is secured to the fixing lever.

27. The dealing shoe structure according to claim 25 further comprising a guiding element arranged inside the card-receiving space, wherein the guiding element includes two guiding strips respectively arranged on a left side and a right side of the card-receiving space to form a gradually-shrinking opening.

28. The dealing shoe structure according to claim 25 further comprising a top cover pivotally connected with the casing for covering the card-receiving space.

29. A dealing shoe structure, which is used to receive poker cards and deal out the poker cards, comprising a card shoe, including a casing, a card-receiving space arranged inside the casing for receiving the poker cards, and a card-support inclined board, wherein the casing includes a side hole;

a card pusher device, arranged in the card-receiving space and on the card-support inclined board for pushing the poker cards, and including a first hook; and a fixing lever, arranged inside the card-receiving space, and including a second hook able to hook the first hook, a control rod passing through the side hole and operated to make the second hook separated from the first hook, and a position-restoring element restoring the second hook to an original position to hook the first hook.

30. The dealing shoe structure according to claim 29, wherein one end of the position-restoring element presses against the casing, and another end of the position-restoring element presses against the second hook.

31. The dealing shoe structure according to claim 29 further comprising a guiding element arranged inside the card-receiving space, wherein the guiding element includes two guiding strips respectively arranged on a left side and a right side of the card-receiving space to form a gradually-shrinking opening.

32. The dealing shoe structure according to claim 29 further comprising a top cover pivotally connected with the casing for covering the card-receiving space.

* * * * *